US009700936B2

(12) United States Patent
Holzgruber et al.

(10) Patent No.: US 9,700,936 B2
(45) Date of Patent: Jul. 11, 2017

(54) METHOD AND PLANT FOR THE PRODUCTION OF LONG INGOTS HAVING A LARGE CROSS-SECTION

(71) Applicant: Inteco Special Melting Technologies GmbH, Bruck a.d. Mur (AT)

(72) Inventors: Harald Holzgruber, Bruck an der Mur (AT); Rezvan Ghasemipour, Laab im Walde (AT); Heinz Rumpler, St. Stefan ob Leoben (AT); Sebastian Michelic, Trofaiach (AT); Robert Pierer, Krieglach (AT)

(73) Assignee: Inteco Special Melting Technologies GmbH, Bruck a.d. Mur (AT)

( * ) Notice: Subject to any disclaimer, the term of this patent is extended or adjusted under 35 U.S.C. 154(b) by 0 days.

(21) Appl. No.: 15/108,796

(22) PCT Filed: Dec. 23, 2014

(86) PCT No.: PCT/EP2014/079136
§ 371 (c)(1),
(2) Date: Jun. 29, 2016

(87) PCT Pub. No.: WO2015/101553
PCT Pub. Date: Jul. 9, 2015

(65) Prior Publication Data

US 2016/0325344 A1 Nov. 10, 2016

(30) Foreign Application Priority Data

Dec. 30, 2013 (AT) ..... A 992/2013

(51) Int. Cl.
*B22D 11/041* (2006.01)
*B22D 7/10* (2006.01)
(Continued)

(52) U.S. Cl.
CPC ..... *B22D 11/041* (2013.01); *B22D 7/00* (2013.01); *B22D 7/10* (2013.01); *B22D 9/006* (2013.01);
(Continued)

(58) Field of Classification Search
CPC .... B22D 7/10; B22D 11/0401; B22D 11/041; B22D 11/141
See application file for complete search history.

(56) References Cited

U.S. PATENT DOCUMENTS 3,766,965 A 10/1973 Vallak
3,908,732 A 9/1975 Cooper
(Continued)

FOREIGN PATENT DOCUMENTS

AT 512681 A1 * 10/2013 ..... B22D 11/1281
CH 554 207 9/1974
(Continued)

OTHER PUBLICATIONS

International search report for Application No. PCT/EP2014/079136 dated Jul. 7, 2015.
(Continued)

*Primary Examiner* — Kevin E Yoon
(74) *Attorney, Agent, or Firm* — Bachman & LaPointe, PC

(57) ABSTRACT

Method for producing ingots made of metal having cross-sectional areas of at least 0.10 $m^2$ of a round, square or rectangular shape through casting of metal or molten steel either directly from the casting ladle (1) or using a fireproof lined intermediate vessel (3) in a short, water-cooled ingot mold open downwards (4) and withdrawing of the solidified ingot (6) from the same downwardly movable withdrawing tool (8), wherein the casting process is continued with a casting rate determined in accordance with the casting
(Continued)

cross-section for as long as the desired or maximum ingot length determined by the height of lift of the withdrawing tool (8) is reached, and additional liquid metal is fed at the end of the regular casting process to an extent that at least the contraction of the metal and steel melt occurring during solidification is balanced during, and whereby after completion of the regular casting process and completion of the ingot withdrawal, the casting process is continued with a casting rate reduced by at least the Factor 10 from the heatable casting ladle (1) or the heatable intermediate vessel (3) or a distribution container, and is reduced progressively or continuously at the end of the solidification to 10% the rate at the start of the additional casting.

7 Claims, 5 Drawing Sheets

(51) Int. Cl.

| | |
|---|---|
| ***B22D 11/04*** | (2006.01) |
| ***B22D 11/111*** | (2006.01) |
| ***B22D 11/115*** | (2006.01) |
| ***B22D 11/12*** | (2006.01) |
| ***B22D 11/14*** | (2006.01) |
| ***B22D 23/10*** | (2006.01) |
| ***C22B 9/18*** | (2006.01) |
| ***B22D 7/00*** | (2006.01) |
| ***B22D 9/00*** | (2006.01) |
| ***B22D 11/059*** | (2006.01) |

(52) U.S. Cl.
CPC ..... *B22D 11/0401* (2013.01); *B22D 11/0406* (2013.01); *B22D 11/059* (2013.01); *B22D 11/111* (2013.01); *B22D 11/115* (2013.01); *B22D 11/122* (2013.01); *B22D 11/1213* (2013.01); *B22D 11/141* (2013.01); *B22D 23/10* (2013.01); *C22B 9/18* (2013.01)

(56) References Cited

U.S. PATENT DOCUMENTS

| | | | | |
|---|---|---|---|---|
| 4,607,682 | A | 8/1986 | Dantzig et al. | |
| 4,744,407 | A | 5/1988 | Fishman et al. | |
| 4,889,178 | A * | 12/1989 | Nigris ..... | B22D 11/141 164/263 |
| 8,944,142 | B2 | 2/2015 | Nikrityuk et al. | |
| 2005/0098298 | A1 | 5/2005 | Dvoskin et al. | |
| 2012/0160442 | A1 | 6/2012 | Anderson et al. | |
| 2016/0023269 | A1 * | 1/2016 | Oh ..... | B22D 11/124 164/485 |

FOREIGN PATENT DOCUMENTS

| | | | |
|---|---|---|---|
| DE | 2 250 710 | | 12/1973 |
| DE | 10 2005 010 838 | A1 | 9/2006 |
| DE | 10 2007 037 340 | A1 | 2/2009 |
| DE | 10 2007 037 340 | A1 | 9/2009 |
| DE | 10 2011 085 932 | A1 | 12/2012 |
| DE | 10 2013 214 811 | A1 | 7/2014 |
| GB | 1 335 383 | A | 10/1973 |
| GB | 1405167 | A | 9/1975 |
| JP | 07144255 | | 11/1993 |

OTHER PUBLICATIONS

Austrian Office action dated Nov. 3, 2014 for Austrian Application No. 992/2013.

* cited by examiner

METHOD AND PLANT FOR THE PRODUCTION OF LONG INGOTS HAVING A LARGE CROSS-SECTION

STATE OF THE ART

The present invention relates to a method for producing long ingots having large cross-sections and lengths, which significantly exceed those in the conventional ingot casting in ingot mold with partial use of known technologies and more advantageous utilization of their features. Moreover, the invention relates to a plant for the execution of the method according to invention. The object is to produce for example circular ingots or also polygonal, square or rectangular formats with diameters for the circular ingots in the range of over 300 mm and equivalent cross-section for other cross-section shapes and lengths of over 5 m.

The production of large cylindrical circular ingots of 600 mm and above and ingot lengths of up to 5 m or more through casting in grey cast iron ingot molds is known, wherein adhesion of the ingot in the ingot mold when stripping the same as well as an insufficient solidification structure in the core with segregations, faults and cavities are to be noted as substantial problems among others.

Such long, cylindrical ingots are preferably used in ring-rolling mills, where these are cut into short ingot discs and are perforated before use in the ring-rolling mill, so that the center of insufficient quality is removed. However, the use of such ingots for other products is only possible to a limited extent due to the insufficient quality of the ingot center.

Also the service life of the grey cast iron ingot molds is limited and thus represents a significant cost factor.

Plants for continuous casting of large cross-sections with diameters of 600 mm and 800 mm are also known. The difficulty here is that the plants must be maintained as sheet feeders to avoid extreme construction heights, in order to control the appearing liquid pool lengths within the range from 25 m to 30 m approximately at usual casting speed of 0.15 m/min to 0.30 m/min. Therefore, at usual casting times of max. 90 min, maximum 22 m of slab can be produced for example for each slab in the case of casting dimensions of 600 mm round or 50 t, wherein the slab is not even solidified at the initial part of the slab upon completion of the casting operation at a solidification time of approximately 115 min. Thus, the slab must be drawn and straightened in a partially solidified state.

The process of solidification in the casting bow and partially in the horizontals leads to an eccentric residual solidification amongst others with accumulation of segregations and entrapments, in a manner that such casting products can also be only used in a limited manner for high-quality products.

Longer slabs with corresponding longer casting times can be produced at the time when an intermediate vessel with sufficient volume is present and a change of the ladle can be conducted or a heating operation of the ladle is possible using electrodes or plasma torches.

The large liquid pool lengths, as mentioned above, require large casting radii of up to 18 m in order to ensure solidification of the large cross-section up to the end of the propelling-straightening section and the initial part of the cutting section.

In each case, continuous casting of large cross-sections in sheet feeders requires an elaborate design of the supporting roller corsets of the plant as well as the use of a likewise elaborate propelling-straightening framework due to the high slab weights in order to remove the slab with precisely controlled speed and to straighten the large cross-section.

As a result, such plants require high investment costs, which can only be hardly amortized or cannot be amortized, if its high capacity cannot be utilized.

A single-slab system for a cross-section of 600 mm round has a casting performance of approximately 550 kg/min or 33 t/h; thus, a 50 t melt can be casted in 1.5 h. Provided that set-up times of 2.5 h are expected, such plant can produce approximately 75,000 t in a year at 6000 h operating time. Proportionately more could be produced in case of ladle change and longer casting times.

Often, only 20,000 t to 25,000 t of such products are required. However, the payoff of such plant cannot be represented based on these quantities.

Provided that larger cross-sections are required, such as 800 mm or 1000 mm round for instance, the conditions are yet more unfavorable.

An additional disadvantage of continuous casting is that it leads to the formation of deep primary cavities upon completion of the casting operation, whereby the output is negatively influenced.

DISCLOSURE OF INVENTION

The aim of the invention is to avoid the above mentioned disadvantages and to enable an economical production also of lower quantities of ingots with diameters of 300 mm and above and ingot lengths of more than 5 m, and at the same time to improve the quality level in comparison with the above mentioned known methods.

This aim shall be accomplished according to the invention in a method with the characteristic features disclosed herein by the fact that the casting process is continued with a casting rate determined in accordance with the casting cross-section for as long as the desired or maximum ingot length determined by the height of lift of the withdrawing tool is achieved and additional liquid metal is fed upon completion of the casting operation to an extent that at least the contraction occurring during solidification of the metal and steel melt is balanced.

Beneficial developments of the method according to the invention are listed in the sub-claims. All combinations from at least two of the features disclosed in the claims, the description and/or the figures fall within the scope of the invention.

The slab withdrawn from the ingot mold is cooled in a secondary cooling zone through spray water, spray mist or compressed air during ingot withdrawal and even after completion thereof. After completion of the casting process and ingot withdrawal, the secondary cooling can be continued with a reduced scope as a maximum up to the complete solidification, wherein additional liquid steel is fed either with a significantly reduced casting speed as compared with the casting process or by melting a consumable electrode, so that at least the contraction occurred during solidification is balanced.

The additional delivery of molten material can be carried out after completion of the casting process, for example, such that after removal of the casting ladle and of an intermediate vessel used for all purposes, the meniscus in the ingot mold is covered with a metallurgically effective slag layer and is heated by melting a consumable electrode following the electroslag remelting process until the complete casting cross-section is solidified. Thereby, it is essential that the heating is performed immediately upon completion of the casting operation with high melting rates in kg/h in the range between 0.5-2.5-fold the ingot diameter in mm. Instead of the ingot diameter, in case of square ingots, the side length is used, and in case of rectangular formats, the half of the sum of the narrow side and the long side is used for determining the melting rate.

The used fusible electrodes must correspond primarily to the composition of the ingot with respect to their chemical composition.

The heating is preferably maintained during the complete solidification process, wherein the melting rate is gradually or continuously reduced to 5-10% of the initial value until completion of the solidification.

The molten metal quantity should correspond minimum to 2% up to max. to 10% of the total weight of the ingot.

An additional delivery of the molten material after completion of the regular casting process and completion of the ingot withdrawal can be carried out also with a casting rate reduced at least by the Factor 10, wherein this additional casting rate is reduced at the end of the solidification to 10% of the rate at the beginning of the additional casting, so that the metal level in the ingot mold rises only slightly.

The supply of additional liquid material can also be achieved continuing the casting process after completion of the ingot withdrawal with, at the most, the more regular casting rate, so that the metal level in the ingot mold rises over the upper edge of the ingot mold in an insulated top piece lined by ceramic mounted on the ingot mold until an additional height of max. 10% of the regularly casted ingot length is reached. In order to avoid a premature solidification of the liquid metal in the top piece, the top piece can be additionally heated.

In order to ensure a good solidification structure, the liquid pool can be stirred during the regular casting process through an electromagnetic stirrer, which is affixed either in the ingot mold section or immediately below the ingot mold, wherein the stirring process can be continued also upon completion of the casting operation and after completion of the lowering phase.

Furthermore, it can be provided that the liquid metal pool is stirred through a vertically movable electromagnetic stirrer during the regular casting and lowering process on the lowering platform immediately above the bottom part, wherein the stirrer is still after completion of the lowering process upwardly movable in the vertical direction with progressive solidification.

BRIEF DESCRIPTION OF THE DRAWINGS

A detailed description of embodiments of the invention follows, with referenced to the attached drawings, wherein.

DESCRIPTION OF EXEMPLARY EMBODIMENTS

Figure 1:
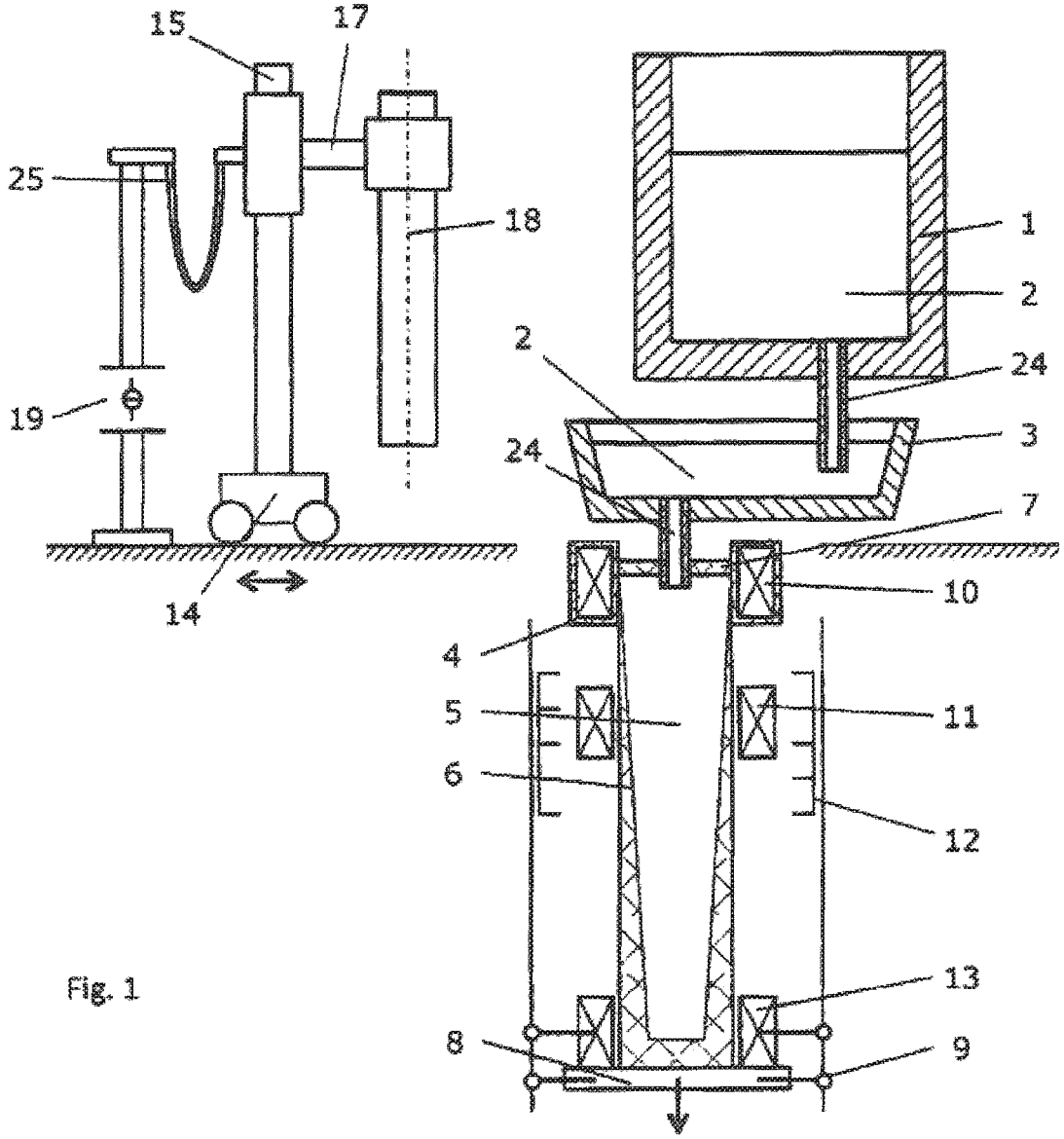
FIG. 1 shows an electroslag heating system in a waiting position.

FIG. 1 shows a schematic representation of a plant suitable for the implementation of the method according to the invention during the regular casting process. The liquid metal 2, preferably liquid steel, contained in a lined casting ladle 1 arrives across a likewise lined intermediate vessel 3 at the short, water-cooled, oscillating ingot mold 4, which may be provided with an ingot mold stirrer 10 in the liquid metal pool 5, which is enclosed by the solidified slab shells of the casting ingot 6 being formed.

The metal level in the ingot mold 4 is generally covered through casting powder 7. It is also possible to perform the metal feeding to the ingot mold 4 directly from the casting ladle 1, and to be dispensed with the intermediate vessel 3. The liquid metal 2 is lead through so-called ceramic shrouds 24 for protection against oxidation.

The ingot 6 being formed, which is resting on a bottom plate 8 with the withdrawing mechanism 9, is detached downwards according to the casting speed until the desired or max. possible ingot length based on the plant design is reached.

In addition to the optionally provided electromagnetic ingot mold stirrer 10, an electromagnetic stirrer 11 can also be applied below the ingot mold 4 in the area of the secondary cooling zone 12.

Furthermore, an electromagnetic stirrer 13 movable in the vertical direction can be moved downwards with the bottom plate 8 during the casting process and can be moved upwards after completion of the lowering process with proceeding solidification along the ingot 6.

In FIG. 1, an electroslag heating system is shown in waiting position, which can be moved into the melting or casting position after completion of the casting process. The plant consists of a moving device 14, which can also be designed as pivoting device. Said device bears a mast 15 along which an electrode carriage 16 is arranged in a movable way, which in turn bears a consumable electrode 18 in an electrode support arm 17. Instead of a consumable electrode, a non-consumable graphite electrode can also be applied. The system is connected to an AC or DC source 19 via the heavy current busbar 17 shown in FIG. 2 and the flexible high current cable 25.

Figure 2:
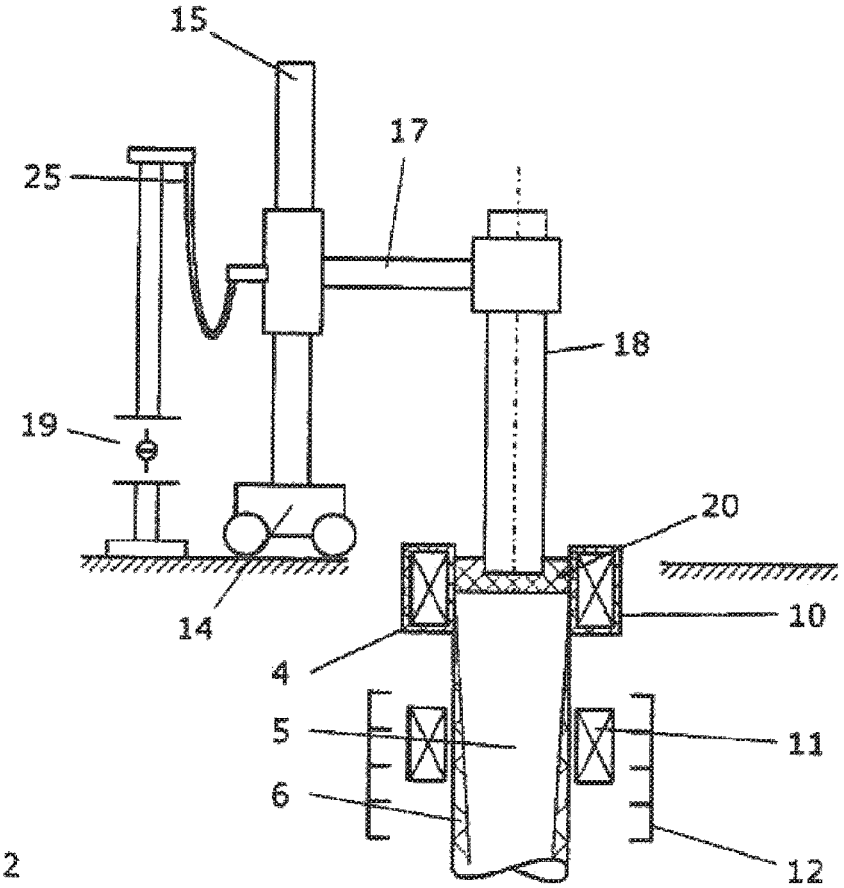
FIG. 2 shows a plant in accordance with the present invention.

FIG. 2 shows a plant in accordance to the invention, in which, on the one hand, the ingot 6 is heated by melting a consumable electrode 18 after completion of the regular casting process following the electroslag remelting process after application of a metallically active slag bath 20, and, on the other hand, the liquid material is fed in the molten liquid pool 5.

Figure 3:
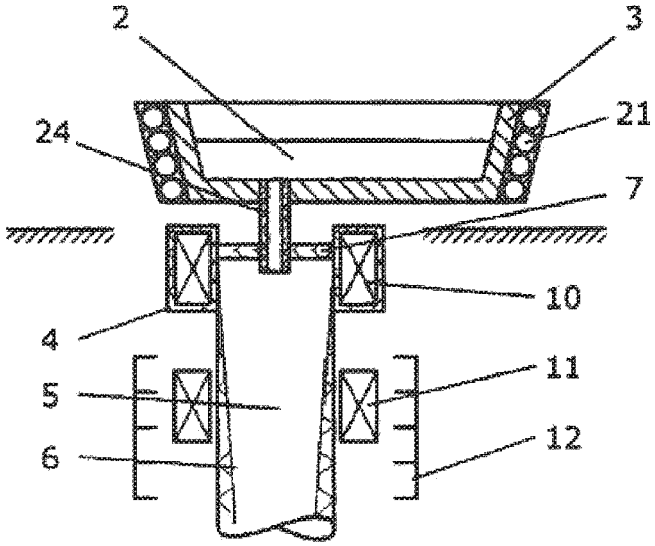
FIG. 3 shows a plant in accordance with the invention.

FIG. 3 shows a plant according to the invention with an intermediate vessel 3, which can be heated for example using built-in induction coil 21.

Figure 4:
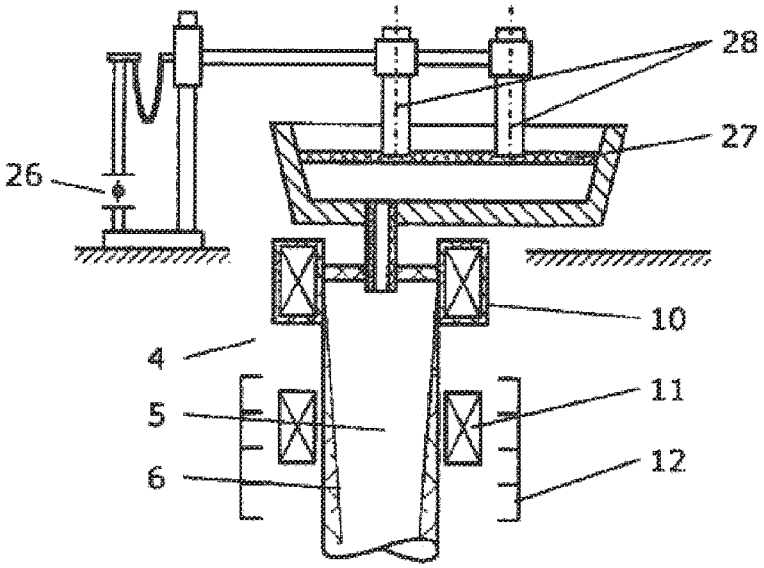
FIG. 4 shows a plant according to the invention.

FIG. 4 shows a plant according to the invention with an intermediate vessel 3, which is heated following the electroslag heating process after application of a metallically active slag bath 27 through electrodes 28, which are electrically powered by a power source 26.

Figure 5:
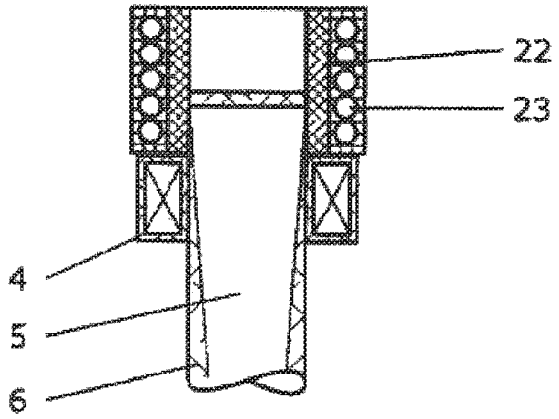
FIG. 5 shows an ingot mold part of a plant according to the invention.

FIG. 5 shows the ingot mold part of a plant according to the invention, on which a ceramic insulating top piece 22 is mounted which has been filled with a liquid melt, which can be kept warm, for example, through inductive heating 23, through continuing the casting process after achieving the provided ingot length and completion of the ingot withdrawal.

The invention claimed is:

1. Method for producing ingots made of metal having cross-sectional areas of at least 0.10 $m^2$ of a round, square or rectangular shape through casting of metal or molten steel either directly from a casting ladle (1) or using a fireproof lined intermediate vessel (3) in a short, water-cooled ingot mold open downwards (4) and withdrawing of solidified ingot (6) from the same downwardly movable withdrawing tool (8), wherein the casting process is continued with a casting rate determined in accordance with the casting cross-section for as long as the desired or maximum ingot length determined by the height of lift of the withdrawing tool (8) is reached, and additional liquid metal is fed at the end of the regular casting process to an extent that at least the contraction of the metal and steel melt occurring during solidification is balanced during, and whereby after completion of the regular casting process and completion of the ingot withdrawal, the casting process is continued with a casting rate reduced by at least the Factor 10 from the heatable casting ladle (1) or the heatable intermediate vessel (3) or a distribution container, and is reduced progressively or continuously at the end of the solidification to 10% the rate at the start of the additional casting.

2. Method according to claim 1, wherein the ingot (6) withdrawn from the ingot mold (4) is guided during the casting process through a secondary cooling zone (12), where it can be cooled through spray water, spray mist or compressed air, and wherein this cooling is progressively or continuously reduced during the remaining solidification phase after the end of the casting process and completion of the ingot withdrawal.

3. Method according to claim 2, wherein the quantity melted during the solidification corresponds to 2-10% of the total weight of the ingot (6).

4. Method according to claim 1, wherein after completion of the regular casting process and completion of the ingot withdrawal, the casting process is continued with, at the most, the regular casting speed, so that the level of the metal in the ingot mold (4) rises up to the upper edge of the ingot mold until an additional height of max. 10% of the ingot length is reached in an insulated top piece (22) lined by ceramic mounted on the ingot mold (4).

5. Method according to claim 4, wherein the insulated top unit (22) lined by ceramic is additionally heated.

6. Method according to claim 1, wherein the ingots are made of steel.

7. Method according to claim 1, wherein the ingots are of a round shape.

* * * * *